US009281598B2

(12) United States Patent
Zebhauser et al.

(10) Patent No.: US 9,281,598 B2
(45) Date of Patent: Mar. 8, 2016

(54) CONTACT ELEMENT

(71) Applicant: ROSENBERGER HOCHFREQUENZTECHNIK GMBH & CO. KG, Fridolfing (DE)

(72) Inventors: Martin Zebhauser, Laufen (DE); Willem Blakborn, Inzell (DE); Helmut Mühlfellner, Kirchanschöring (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 14/428,081

(22) PCT Filed: Jul. 22, 2013

(86) PCT No.: PCT/EP2013/002159

§ 371 (c)(1),
(2) Date: Mar. 13, 2015

(87) PCT Pub. No.: WO2014/040670

PCT Pub. Date: Mar. 20, 2014

(65) Prior Publication Data

US 2015/0229058 A1 Aug. 13, 2015

(30) Foreign Application Priority Data

Sep. 17, 2012 (DE) ..... 20 2012 008 961 U

(51) Int. Cl.

| | |
|---|---|
| ***H01R 9/24*** | (2006.01) |
| ***H01R 13/24*** | (2006.01) |
| ***H01R 13/03*** | (2006.01) |
| ***H01R 13/11*** | (2006.01) |

(Continued)

(52) U.S. Cl.

CPC ..... *H01R 13/2492* (2013.01); *H01R 13/03* (2013.01); *H01R 13/111* (2013.01); *H01R 13/2407* (2013.01); *H01R 13/2442* (2013.01); *H01R 13/26* (2013.01); *H01R 13/6582* (2013.01)

(58) Field of Classification Search

CPC .. H01R 13/03; H01R 13/111; H01R 13/2407; H01R 13/2442; H01R 13/2492

USPC ..... 439/884, 520, 607.17, 607.19, 637, 439/862, 886

See application file for complete search history.

(56) References Cited

U.S. PATENT DOCUMENTS 1,477,527 A * 12/1923 Raettig ..... H01H 1/42 200/282
3,192,498 A * 6/1965 Ruehlemann ..... H01R 13/111 439/223
3,289,146 A * 11/1966 Tuchel ..... H01R 13/112 439/630

(Continued)

FOREIGN PATENT DOCUMENTS

EP 2500983 A2 9/2012

*Primary Examiner* — Neil Abrams
*Assistant Examiner* — Travis Chambers
(74) *Attorney, Agent, or Firm* — DeLio, Peterson & Curcio LLC; Robert Curcio

(57) ABSTRACT

A contact element for making electrical contact with a contact area of a mating contact element, wherein a contact region forms at least two contact points, and wherein the two contact points are distinguished from one another in the new state in respect of the distance from the contact area of the mating contact element, so that, in the new state, a first of the contact points makes contact with the contact area and, after a defined amount of wear of the first contact point, the second contact point makes contact with the contact area.

12 Claims, 2 Drawing Sheets

(51) Int. Cl.
*H01R 13/26* (2006.01)
*H01R 13/6582* (2011.01)

(56) References Cited

U.S. PATENT DOCUMENTS 3,474,380 A * 10/1969 Miller ..... H01R 12/721 439/520
3,585,573 A * 6/1971 Robshaw ..... H01H 1/36 439/886
3,601,774 A * 8/1971 Stathos ..... H01R 12/721 439/637
3,631,381 A * 12/1971 Pittman ..... H01R 12/721 439/637
3,808,578 A * 4/1974 Hansen ..... H01R 12/721 439/595
3,876,274 A * 4/1975 Ruehlemann ..... H01R 12/716 439/248
4,026,627 A * 5/1977 Benasutti ..... H01R 12/721 439/377
4,519,666 A * 5/1985 Williams ..... H01R 4/10 29/879
4,734,041 A * 3/1988 Bruchmann ..... H01R 12/82 439/637
4,747,794 A * 5/1988 Seidler ..... H01R 13/193 439/295
4,778,231 A * 10/1988 Seidler ..... H01R 13/193 439/295
4,795,379 A * 1/1989 Sasaki ..... H01R 13/11 439/856
5,009,606 A * 4/1991 Villeneuve ..... H01R 12/714 439/59
5,286,215 A * 2/1994 Dewey ..... H01R 12/721 439/188
6,095,873 A * 8/2000 Muramatsu ..... H01R 11/22 439/852
6,283,774 B1 * 9/2001 Funatsu ..... H01R 13/26 439/181
6,482,041 B1 11/2002 Yen
6,645,012 B2 * 11/2003 Ito ..... H01R 12/721 439/637
7,229,321 B2 * 6/2007 Hegel ..... H01R 13/112 439/637
8,864,524 B2 * 10/2014 Sato ..... H01R 12/57 439/630
9,017,084 B2 * 4/2015 Sato ..... H01R 13/2442 439/152
9,033,750 B2 * 5/2015 Miller ..... H01R 13/26 439/862
9,112,292 B2 * 8/2015 Ogura ..... H01R 13/11
2008/0070452 A1 * 3/2008 Komiyama ..... H01R 13/113 439/852
2011/0151709 A1 6/2011 Kim
2012/0184137 A1 7/2012 Patel

* cited by examiner

CONTACT ELEMENT

BACKGROUND OF THE INVENTION

1. Field of the Invention

The invention relates to a contact element with at least one contact point for making contact with a contact surface of a mating contact element.

2. Description of Related Art

Contact elements are, for example, used in plug connectors by means of which conductors are connected together for the transmission of electrical supply energy or of signals. In order to achieve a low-loss transmission of the electrical energy or the signals, it is necessary that the contact element makes permanent contact with the contact surface of the mating contact element. External influences such as, in particular, mechanical loads on the plug connection, vibratory stress or also thermal influences may not significantly influence the transmission quality.

In order to achieve a permanent contact between the contact point of the contact element and the contact surface of the mating contact element, it is known for the contact point to press in a spring-loaded manner against the contact surface, as a result of which possible relative movements of contact point and contact surface are compensated. For this purpose, the contact elements can for example be designed in the form of a spring tab which is deflected elastically on making contact with the mating contact element.

Contact elements frequently comprise a base body made of metal which is provided with a coating which, in comparison with the material of the base body, is distinguished among other things by an improved contact resistance in combination with the mating contact element. In some cases it has proved problematic in such contact elements that the coating becomes worn, i.e. is eroded, relatively quickly when subjected to vibratory stresses. This can lead to an increase in the contact resistance, and the contact element or the entire plug connection in which this is used becomes unserviceable.

SUMMARY OF THE INVENTION

Bearing in mind the problems and deficiencies of the prior art, it is therefore an object of the present invention to improve a contact element of the generic type in terms of its service life.

It is another object of the present invention to make possible the transmission of electrical supply energy or signals with low contact resistance.

The above and other objects, which will be apparent to those skilled in the art, are achieved in the present invention which is directed to a system having a contact element for making electrical contact with a contact surface of a mating contact element and the mating contact element with the contact surface for making contact with the contact element, wherein the contact element has a base body which at least in one section includes a coating and a contact region which forms at least two contact points, such that the two contact points are distinguished from one another in a new state in respect of the distance from the contact surface of the mating contact element, so that in the new state a first contact point makes contact with the contact surface and, after a defined amount of wear of the first contact point, the second contact point makes contact with the contact surface, wherein the second contact point makes contact with the contact surface when the coating in the region of the first contact point has been removed through wear.

At least one of the contact points may be formed by a curved section of a surface of the contact element, and wherein the difference in distance may amount to approximately 0.02 mm to 0.03 mm.

Additionally, the contact element may be designed as a spring tab. The system may also include a contact part comprising a plurality of contact elements which are arranged in the form of a spring cage. The contact part is designed as a bent sheet metal component.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
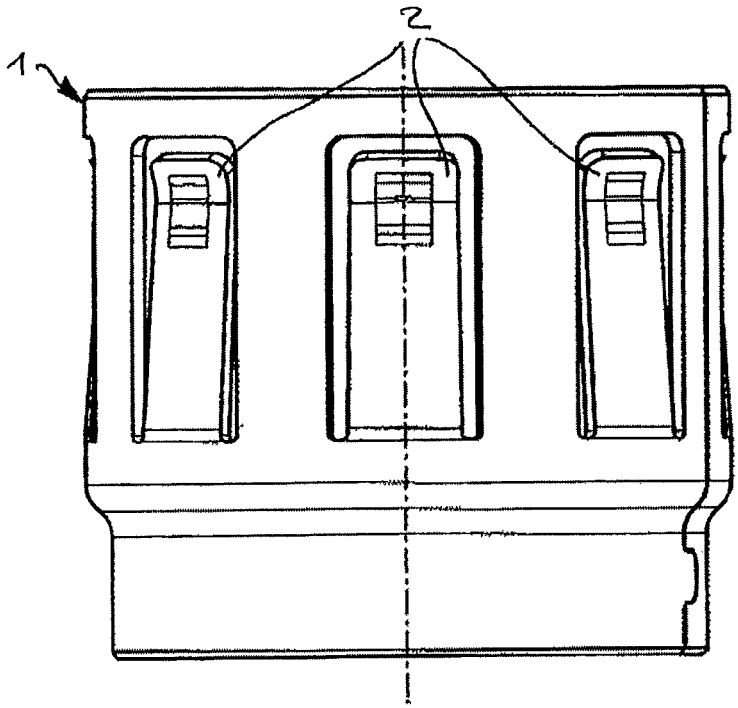
FIG. 1 shows a side view of a contact part according to the invention in the form of a spring cage.
Figure 2:
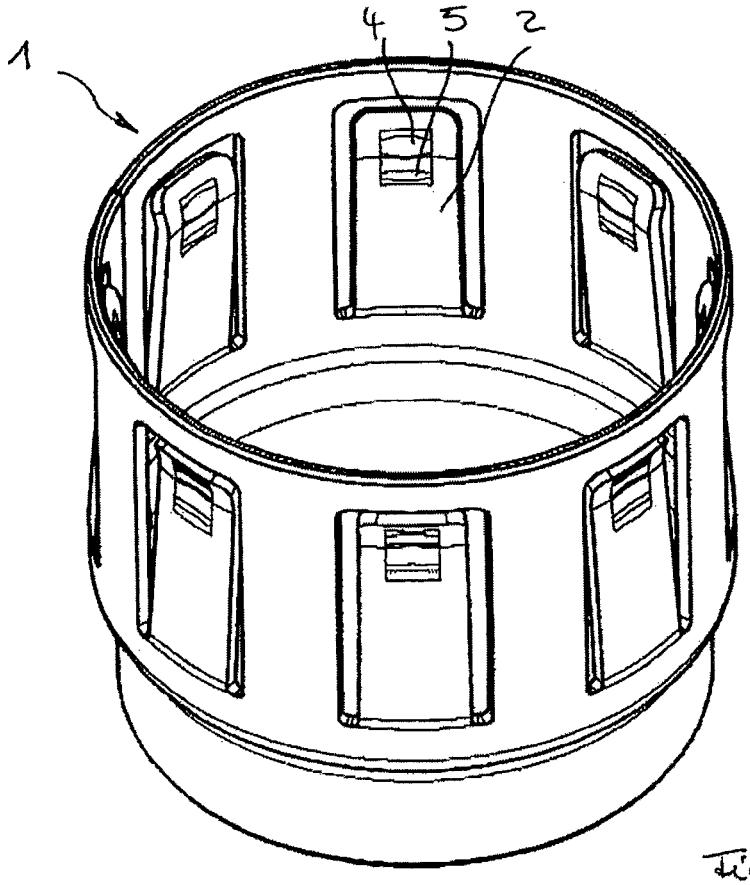
FIG. 2 shows a perspective view of the contact part according to FIG. 1.
Figure 3:
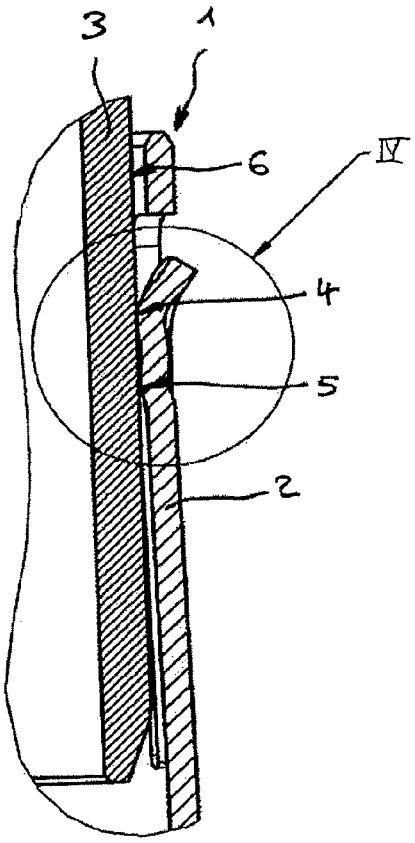
FIG. 3 shows a longitudinal section through a part of a system according to the invention consisting of the contact part according to FIGS. 1 and 2 and a mating contact element.
Figure 4:
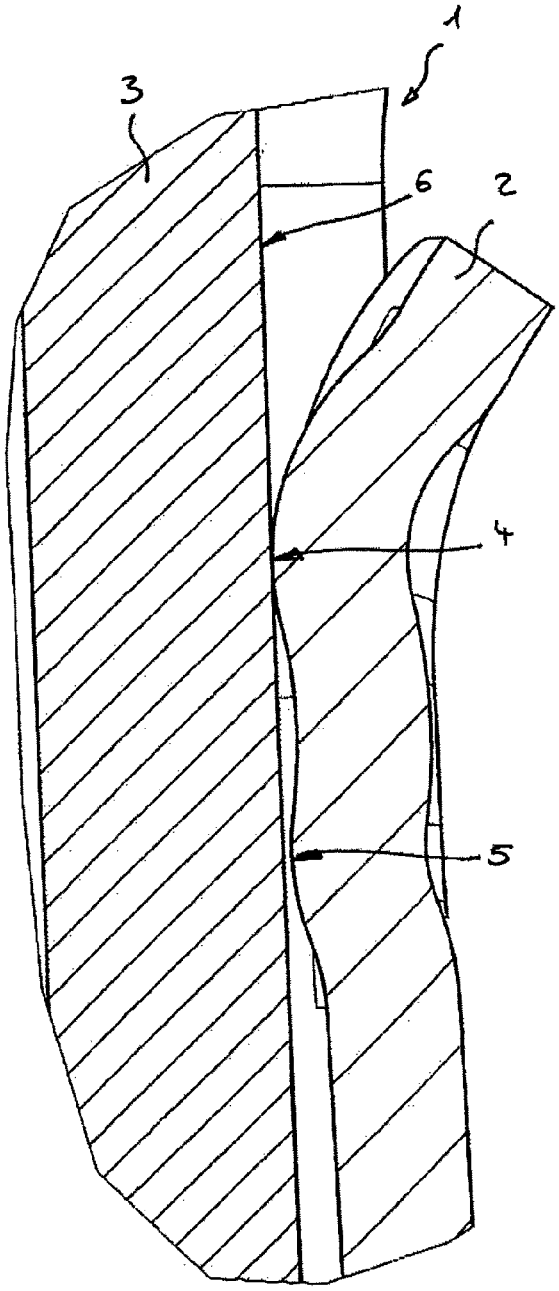
FIG. 4 shows an enlarged section (IV) from FIG. 3.

In describing the preferred embodiment of the present invention, reference will be made herein to FIGS. 1-4 of the drawings in which like numerals refer to like features of the invention.

Starting out from the aforementioned prior art, the invention was based on the problem of improving a contact element of the generic type in terms of its service life.

This problem is solved through a contact element according to the claims. A contact part with a plurality of contact elements according to the invention and a system consisting of a contact element according to the invention or a contact part according to the invention together with a complementary mating contact element are the subject matter of this disclosure and the claims. Advantageous embodiments of the contact element according to the invention as well as of the contact parts according to the invention are the subject of the claims and are explained in the following description of the invention.

According to the invention, a contact element of the generic type for making electrical contact with a contact surface of a mating contact element is further developed in that at least two contact points are formed, wherein the two contact points are distinguished from one another in the new state in respect of the distance from the contact surface of the mating contact element, so that, in the new state, a first contact point makes contact with the contact surface and, after a defined amount of wear of the first contact point, the second contact point (possibly together with the first contact point) makes contact with the contact surface.

A contact element is thus created the service life of which can be extended possibly to several times that of contact elements of the generic type, since several contact points are formed which in succession make possible the transmission of electrical supply energy or signals with low contact resistance.

Preferably, the contact element can have a base body and a coating applied to the base body (in at least one section), wherein the second contact point makes contact with the contact surface when, as a result of wear, the coating is reduced in thickness or removed in the region of the first contact point. The base body can thereby preferably be made of metal and in particular a metal on the basis of copper and the coating can also be based on a metal and in particular nickel. Alternatively however, the base body can also be formed of a (possibly electrically conductive) plastic which can in turn preferably be provided with a metallic coating.

Also preferably, at least one, preferably all of the contact points is/are formed by a (preferably three-dimensional) curved and in particular partially spherical section of a surface of the contact element. This allows a contact point to be provided which is largely uninfluenced in terms of positional tolerances of the contact element in relation to the contact surface.

The difference in distance between the two contact points in the new state of the contact elements can preferably only amount to approximately 0.02 mm to 0.03 mm. Where the contact element comprises a base body with a coating, this can also correspond to the preferred thickness of the coating, wherein, particularly preferably, the difference in distance can be slightly less than the thickness of the coating. This makes it possible to ensure that the second contact point already makes contact with the contact surface when the coating on the first contact point has been completely eroded.

The contact element according to the invention can advantageously be formed as a spring tab. This allows a simple and economical manufacture of a spring-loaded contact element which presses against the contact surface of the mating contact element.

The invention also relates to a contact part with a plurality of contact elements in the form of spring tabs which are arranged in the form of a spring cage.

A "spring cage" is understood to mean a contact part the contact elements of which are disposed in a spatial arrangement such that these make contact, in particular, with a three-dimensional (and thus not completely flat) contact surface of the mating contact element. In particular, in such a spring cage the contact elements can be arranged in a ring.

Also preferably, the spring cage can (preferably) be formed in a single piece as a bent sheet metal component and in particular as a stamped and bent component.

Furthermore, the invention relates to a system of a contact element according to the invention or a contact part according to the invention and a mating contact element with a contact surface for making contact with the contact element(s).

The contact element according to the invention or the contact part according to the invention or the system according to the invention is, particularly preferably, suitable for the transmission of radio frequency signals (RF signals).

FIGS. 1 to 4 show an embodiment of a system according to the invention with a contact part 1 according to the invention with a plurality of contact elements 2 which make contact with a mating contact element 3. The system is used for the transmission of RF signals.

The contact part 1 according to the invention is designed in the form of a spring cage. This is formed by a stamped and bent component with a circular cross section in the wall of which the contact elements 2 are integrated in the form of spring tabs.

The spring cage (or a base body thereof) consists of a metallic material, for example phosphorus bronze. A coating for the base body can also be provided which can, for example, be nickel-based and can improve the contact resistance between the contact part 1 and the mating contact element 3 in comparison with the phosphorus bronze.

The contact elements 2 each form a contact region at their free ends. Two contact points 4, 5 are provided in each of these contact regions which are formed by the outer side of a partially spherical section of the contact element 2. These partially spherical sections can be introduced into the contact elements 2 simply by means of a forming process.

When the mating contact element 3, in the form of a plug, is plugged into the spring cage, the contact elements 2 are elastically deformed radially outwards. As a consequence, the contact elements 2 press, in a spring-loaded manner, against a contact surface 6 formed by the outer side of the mating contact element.

According to the invention, in the new state of the contact part 1 only a first contact point 4 arranged nearer to the free end of the relevant spring tab makes contact with the contact surface 6. In contrast, a defined distance of approximately 0.02 mm to 0.03 mm is provided between the respective second contact point 5 and the contact surface 6 (see FIG. 4). In the new state, therefore, only the first contact points 4 of the contact elements 2 are responsible for the transmission of the RF signals from the contact part 1 to the mating contact element 3.

If the system is subjected to continuous vibrations, i.e., vibratory stress, or repeated plugging and disconnecting movements in which the contact part 1 is slid over the contact surface 6 of the mating contact element 3, this can lead to wear on the first contact points 4 which in particular leads to a (partial) erosion of the coating on the first contact points 4. This increasing wear leads to the second contact points 5 of the contact elements 2 approaching the contact surface 6 of the mating contact element 3 and eventually making contact with this. This preferably happens shortly before the coating has become completely eroded from the first contact points 4. The coating, which is then present in its full thickness on the second contact points 5 then ensures a continuing good transmission of the RF signals with a relatively low contact resistance.

Naturally, it is also possible to provide more than two, for example three contact points on some or all contact elements 2, wherein for example the third contact points are, in the new state of the contact parts, preferably arranged at the same distance from the second contact points 5 as the second contact points 5 are distant from the first contact points 4.

It is also possible for several first (4) and several second (5) (and if necessary several more) contact points to be provided per contact element 2.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A system having a contact element for making electrical contact with a contact surface of a mating contact element and the mating contact element with the contact surface for making contact with the contact element, wherein the contact element has a base body which at least in one section includes a coating and a contact region which forms at least two contact points, such that the two contact points are distinguished from one another in a new state in respect of the distance from the contact surface of the mating contact element, so that in the new state a first contact point makes contact with the contact surface and, after a defined amount of wear of the first contact point, the second contact point makes contact with the contact surface, wherein the second contact point makes contact with the contact surface when the coating in the region of the first contact point has been removed through wear.

2. The system of claim 1 wherein the difference in distance amounts to approximately 0.02 mm to 0.03 mm.

3. The system of claim 1 wherein the contact element is designed as a spring tab.

4. The system of claim 1 including a contact part comprising a plurality of contact elements which are arranged in the form of a spring cage.

5. The system of claim 4, wherein the contact part is designed as a bent sheet metal component.

6. The system of claim 1, wherein at least one of the contact points is formed by a curved section of a surface of the contact element.

7. The system of claim 6 wherein the contact element is designed as a spring tab.

8. The system of claim 6 wherein the difference in distance amounts to approximately 0.02 mm to 0.03 mm.

9. The system of clam 8 wherein the contact element is designed as a spring tab.

10. The system of claim 8 including a contact part comprising a plurality of contact elements which are arranged in the form of a spring cage.

11. The system of claim 6 including a contact part comprising a plurality of contact elements which are arranged in the form of a spring cage.

12. The system of claim 11, wherein the contact part is designed as a bent sheet metal component.

* * * * *